US010415314B2

(12) United States Patent
Kartha et al.

(10) Patent No.: US 10,415,314 B2
(45) Date of Patent: Sep. 17, 2019

(54) DOWNHOLE MECHANICAL PERCUSSIVE HAMMER DRILL ASSEMBLY

(71) Applicant: HALLIBURTON ENERGY SERVICES, INC., Houston, TX (US)

(72) Inventors: Nikhil M. Kartha, Singapore (SG); Mark S. Holly, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 131 days.

(21) Appl. No.: 15/580,248

(22) PCT Filed: Jul. 8, 2015

(86) PCT No.: PCT/US2015/039537

§ 371 (c)(1),
(2) Date: Dec. 6, 2017

(87) PCT Pub. No.: WO2017/007469

PCT Pub. Date: Jan. 12, 2017

(65) Prior Publication Data

US 2018/0163474 A1 Jun. 14, 2018

(51) Int. Cl.

| | |
|---|---|
| ***E21B 4/06*** | (2006.01) |
| ***E21B 6/02*** | (2006.01) |
| ***E21B 4/10*** | (2006.01) |

(52) U.S. Cl.
CPC . *E21B 4/10* (2013.01); *E21B 6/02* (2013.01)

(58) Field of Classification Search
CPC ..... E21B 4/12; E21B 4/14; E21B 4/06; E21B 1/00; E21B 6/02; E21B 17/03
See application file for complete search history.

(56) References Cited

U.S. PATENT DOCUMENTS

| | | | | | |
|---|---|---|---|---|---|
| 1,899,438 | A | * | 2/1933 | Grant | E21B 4/10 173/105 |
| 2,575,826 | A | | 11/1951 | Mecom | |
| 2,613,917 | A | * | 10/1952 | Postlewaite | E21B 4/10 175/106 |
| 3,363,700 | A | | 1/1968 | Bogusch, Jr. | |
| 3,409,095 | A | | 11/1968 | Bardwell | |
| 3,528,498 | A | | 9/1970 | Carothers | |
| 3,606,930 | A | | 9/1971 | Curington | |
| 3,682,260 | A | | 8/1972 | Klemm | |

(Continued)

FOREIGN PATENT DOCUMENTS

WO WO-2013148521 A1 10/2013

OTHER PUBLICATIONS

Korean Intellectual Property Office, International Search Report and Written Opinion, dated Mar. 22, 2016, 17 pages, International Application PCT/US2015/039537, Korea.

*Primary Examiner* — Kenneth L Thompson

(57) ABSTRACT

A modular, mechanical percussive hammer assembly may be used with drill strings, wireline cable, and coiled tubing. Rotation of a splined driveshaft by downhole electric, hydraulic or mud motor rotates a downwardly-biased hammer and drill body rotatively captured within a upwardly-biased stationary anvil. A bit is carried by the drill body. The hammer contacts and rotates along a cammed control surface of the anvil as the driveshaft is rotated. Interaction between the cammed control surface and the hammer operated to create an axial impact force that is transmitted to the drill body and drill bit.

23 Claims, 6 Drawing Sheets

(56) References Cited

U.S. PATENT DOCUMENTS

| | | | | |
|---|---|---|---|---|
| 3,807,512 | A | 4/1974 | Pogonowski et al. | |
| 4,558,749 | A | 12/1985 | Fulkerson | |
| 4,867,255 | A | 9/1989 | Baker et al. | |
| 5,449,046 | A | 9/1995 | Kinnan | |
| 5,782,311 | A * | 7/1998 | Wentworth | F16L 55/1658 175/106 |
| 5,957,220 | A * | 9/1999 | Coffman | E21B 4/00 173/73 |
| 6,516,902 | B1 | 2/2003 | Klemm | |
| 6,761,231 | B1 | 7/2004 | Dock et al. | |
| 7,237,625 | B2 | 7/2007 | Minshull et al. | |
| 8,011,457 | B2 | 9/2011 | Hall et al. | |
| 8,347,988 | B2 | 1/2013 | Gilbert et al. | |
| 8,739,901 | B2 * | 6/2014 | Cote | E21B 4/10 175/296 |
| 8,783,342 | B2 | 7/2014 | Benson | |
| 2002/0185312 | A1 * | 12/2002 | Armell | E21B 4/10 175/19 |
| 2004/0089461 | A1 | 5/2004 | Cioceanu | |
| 2011/0253456 | A1 | 10/2011 | Conn | |
| 2012/0125691 | A1 | 5/2012 | Strydom | |
| 2012/0247839 | A1 | 10/2012 | Kosovich | |
| 2013/0264119 | A1 | 10/2013 | Gynz-Rekowski et al. | |
| 2014/0182938 | A1 | 7/2014 | Gan et al. | |
| 2016/0108677 | A1 * | 4/2016 | von Gynz-Rekowski | E21B 4/10 175/57 |

* cited by examiner

DOWNHOLE MECHANICAL PERCUSSIVE HAMMER DRILL ASSEMBLY

CROSS-REFERENCE TO RELATED APPLICATIONS

This application is a U.S. national stage patent application of International Patent Application No. PCT/US2015/039537, filed on Jul. 8, 2015, the benefit of which is claimed and the disclosure of which is incorporated herein by reference in its entirety.

TECHNICAL FIELD

The present disclosure relates generally to oilfield equipment, and in particular to downhole tools, drilling systems, and drilling techniques for drilling wellbores in the earth. More particularly still, the present disclosure relates to a method and system for improving the rate of penetration of a drill bit.

BACKGROUND

Down hole drilling units are frequently used for multiple purposes, such as drilling through virgin formation, cleaning a wellbore, drilling through cement plugs, etc. Depending on the task at hand, such downhole drilling units be run on drill strings, wireline cable, or coiled tubing, for example. The cost to drill or service a wellbore may be determined in large part by the effective rate of penetration during drilling operations. Traditional rotating drill bits are useful for shearing and removing weak materials. As well depth increases, formation rock strength may increase, and the mechanical limitations of the drilling string and the drill bits may result in decreased rate of penetration. Similarly, drilling through cement plugs or other downhole tools may result in a low rate of penetration.

Downhole tools that impart axial impact forces to a drill bit may increase rock cutting efficiency while simultaneously reducing the required rock cutting force. Reducing cutting force may result in lower drill bit wear and breakage, less frequently encountered stick-slip conditions, lower probability of shearing the drill string, and a concomitant greater effective rate of penetration. Downhole impact tools that create axial impact forces using a hydraulic flow of drilling fluid that actuate a complex system of valves and pistons may not be particularly optimal for all drilling operations, particularly those operations conventionally performed using wireline or coiled tubing systems.

BRIEF DESCRIPTION OF THE DRAWINGS

Embodiments are described in detail hereinafter with reference to the accompanying figures, in which.

DETAILED DESCRIPTION

Figure 1:
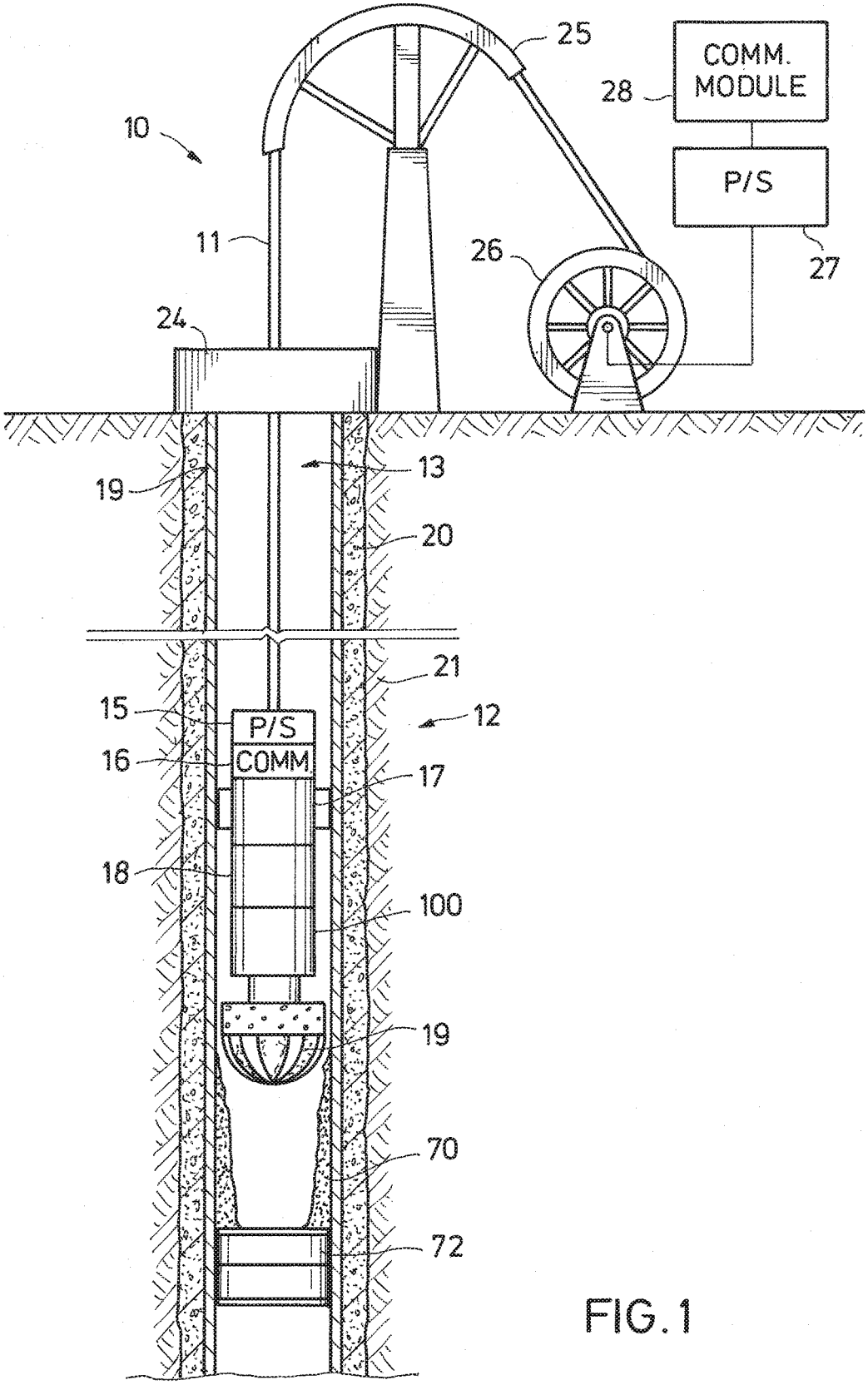
FIG. 1 is an elevation view in partial cross-section of a wireline or coiled tubing system according to an embodiment, showing a downhole tool assembly, including an anchoring device, a motor, and a mechanical percussive hammer assembly, suspended by wireline or coiled tubing for applying repetitive axial impact forces to a bit.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

In the disclosure, like numerals may be employed to designate like parts throughout. Various items of equipment, such as fasteners, fittings, etc., may be omitted to simplify the description. However, routineers in the art will realize that such conventional equipment can be employed as desired.

FIG. 1 is a simplified elevation view in partial cross-section view of a wireline or coiled tubing system 10 according to one or more embodiments. A flexible conveyance 11, which may be a wireline cable or coiled tubing, for example, suspends a downhole tool assembly 12 within a wellbore 13. Wellbore 13 may be lined with casing 19 and a cement sheath 20 and may terminate at the surface with a well head 24. Wellbore 13 can be any depth, and the length of conveyance 11 is sufficient for the depth of operations to be conducted within wellbore 13.

Wireline or coiled tubing system 10 may include a sheave or arcuate rail 25 for guiding the conveyance 11 into wellbore 13. Conveyance 11 may be spooled on a reel 26 storage. Conveyance 11 carries downhole tool assembly 12 and is payed out or taken in to raise and lower downhole tool assembly 12 within wellbore 13, as desired.

In the case of a wireline system, conveyance 11 may be a wireline cable. Electrical conductors within cable 11 may operatively connect downhole tool assembly 12 with surface-located equipment, which may include an electrical power source 27 to provide power to downhole tool assembly 12. Cable 11 may also include electrical conductors and/or optical fibers to provide communications between downhole tool assembly 12 and a communications module 28 at the surface of wellbore 13. In the case of a coiled tubing system, conveyance 11 may be a coiled tubing. Power and communication to downhole tool assembly 12 may be provided by a flow of drilling fluid through the interior of coiled tubing 11, in a manner similar to that of drilling system 22 of FIG. 2, described hereinafter.

According to one or more embodiments, downhole tool assembly 12 may include a mechanical percussive hammer assembly 100, which may rotate and apply repetitive axial impact forces to a distal bit 19, which may be a conventional drill bit, reamer, coring bit, or other suitable tool. Downhole tool assembly 12 may be used, among other purposes, to clean scale 70 or other undesirable accumulation from wellbore 13 and to drill through and clear various plugs or packers 72, such as fracturing and cementing plugs, during well intervention operations.

Downhole tool assembly 12 may also include a motor 18 operable to rotate distal bit 19 and provide mechanical power to percussive hammer assembly 100. A tractor assembly or anchoring device 17 may be provided within downhole tool assembly 12 for counteracting any tendency of downhole tool assembly 12 to rotate within wellbore 13 during rotation of distal bit 19. Tractor assembly or anchoring device 17 may be optional for coiled tubing use but may be generally required for wireline use, because of an inherent inability to effectively push tools with wireline cable. Finally, although not expressly illustrated, downhole tool assembly 12 may include various logging tools, which may generate data useful in analysis of wellbore 13 or in determining the nature of the formation 21 in which wellbore 13 is located.

In the case of a wireline system 10, motor 18 may be an electric motor. Downhole tool assembly 12 may also include a power supply assembly 15 for converting power from surface power source 27 to a suitable form for use by downhole tool assembly 12 and a downhole communications module 16 for maintaining communications with a surface communications module 28. In the case of a coiled tubing system 10, motor 18 may be a hydraulic motor or an electric motor powered by hydraulically-powered electrical generator. Downhole communications module 16 may be adapted for communications via mud pulse telemetry or the like.

Figure 2:
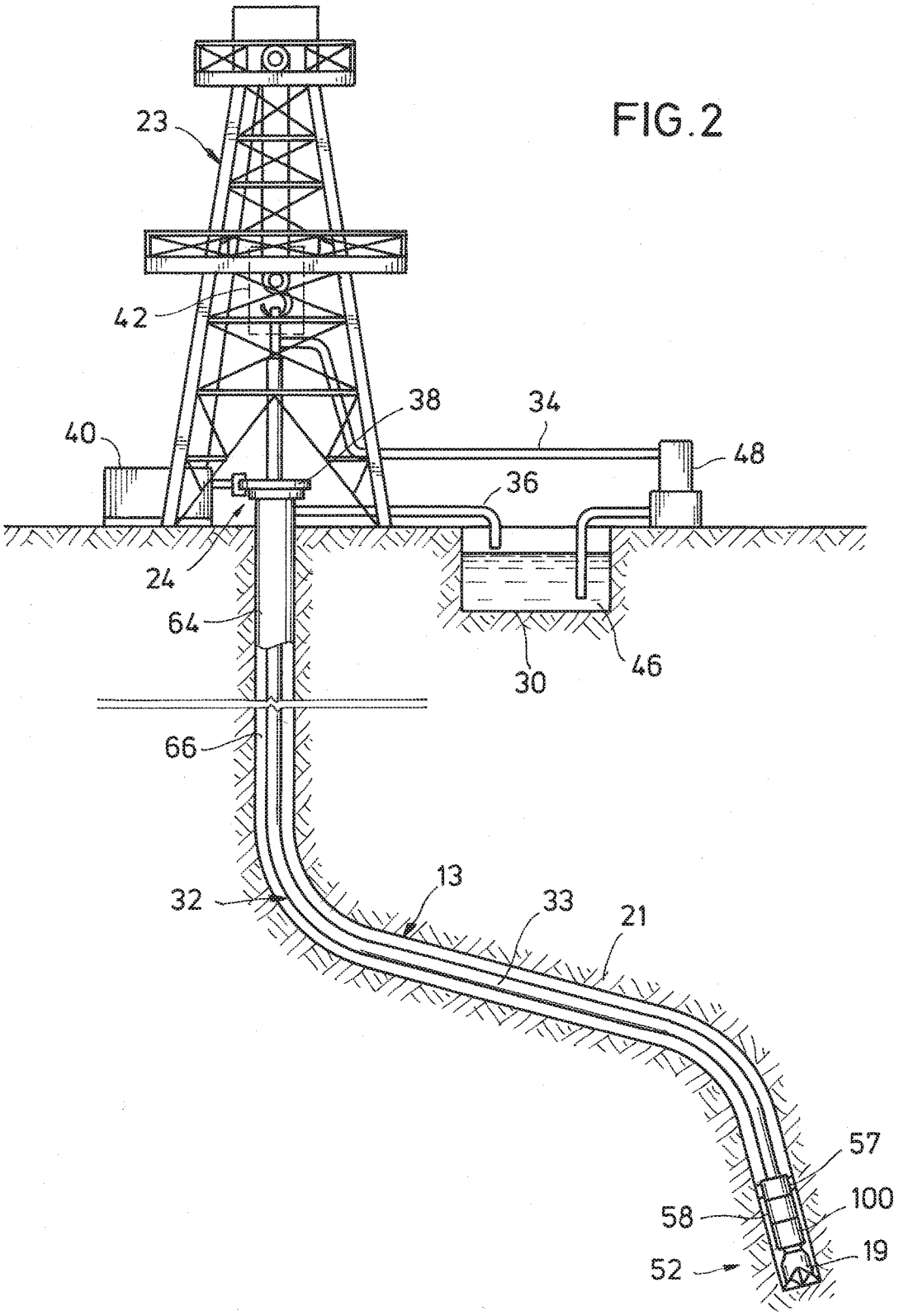
FIG. 2 is an elevation view in partial axial cross-section of a drilling system according to an embodiment, showing a bottom hole assembly, including an anchoring device, a mud motor, and a mechanical percussive hammer assembly, suspended by a drill string for applying axial impact forces to a bit.

FIG. 2 is an elevation view in partial cross-section of a drilling system 22 according to one or more embodiments. Drilling system 22 may be located on land, as illustrated, or atop an offshore platform, semi-submersible, drill ship, or any other platform capable of forming wellbore 13 through one or more downhole formations 21. Drilling system 22 may be used in vertical wells, non-vertical or deviated wells, multilateral wells, offshore wells, etc.

Drilling system 22 may include a drilling rig 23. Drilling rig 23 may be located generally above a well head 24, which in the case of an offshore location is located at the sea bed and may be connected to drilling rig 23 via a riser (not illustrated). Drilling rig 23 may include a top drive 42, rotary table 38, hoist assembly 40 and other equipment associated with raising, lowering, and rotating a drill string 32 within wellbore 13. Blow out preventers (not expressly shown) and other equipment associated with drilling a wellbore 13 may also be provided at well head 24.

Drill string 32 may be assembled from individual lengths of drill pipe, coiled tubing, or other tubular goods. In one or more embodiments, drill string 32 has a hollow interior 33. An annulus 66 is formed between the exterior of drill string 32 and the inside diameter of wellbore 13. The downhole end of drill string 32 may carry a bottom hole assembly 52. Bottom hole assembly 52 may include percussive hammer assembly 100, which may rotate and repetitively apply axial impact forces to distal bit 19. Distal bit 19 may be a conventional drill bit, reamer, coring bit, or other suitable tool. Bottom hole assembly 52 may include a mud motor 58, operable to rotate distal bit 19 and provide mechanical power to percussive hammer assembly 100. However, an electric motor, powered by a hydraulically-powered electrical generator, for example, may be used in lieu of a mud motor. A tractor assembly or anchoring device 57 may be provided within bottom hole assembly 52 for counteracting any tendency of bottom hole assembly 52 to rotate within wellbore 13 during rotation of distal bit 19, particularly if drill string 32 includes coiled tubing. Bottom hole assembly 90 may also include various subs, centralizers, drill collars, logging tools, or similar equipment.

Various types of drilling fluids 46 may be pumped from reservoir 30 through pump 48 and conduit 34 to the upper end of drill string 32 extending from well head 24. The drilling fluid 46 may then flow through longitudinal bore 33 of drill string 32 and exit through nozzles (not illustrated) formed in distal bit 19 or elsewhere in bottom hole assembly 52. Drilling fluid 46 may mix with formation cuttings and other downhole fluids and debris proximate drill bit 92. Drilling fluid 46 will then flow upwardly through annulus 66 to return formation cuttings and other downhole debris to well head 24. Conduit 36 may return the drilling fluid to reservoir 30. Various types of screens, filters and/or centrifuges (not expressly shown) may be provided to remove formation cuttings and other downhole debris prior to returning drilling fluid to pit 30. Drilling fluid 46 may also provide a communications channel between bottom hole assembly 52 and the surface of wellbore 13, via mud pulse telemetry techniques, for example.

Figure 3:
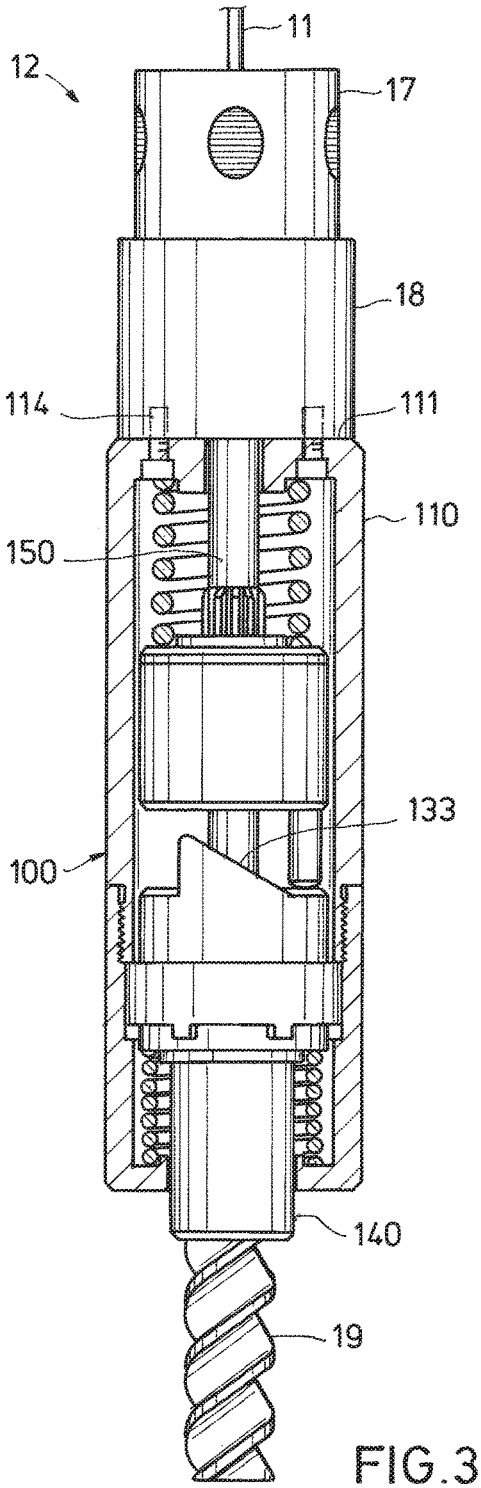
FIG. 3 is an elevation view of the downhole tool assembly of FIG. 1 with the mechanical percussive hammer assembly shown in partial cross-section according to an embodiment.

FIG. 3 is an elevation view of a downhole tool assembly 12 of FIG. 1 according to one or more embodiments. Mechanical percussive hammer assembly 100 is shown in partial cross-section. Percussive hammer assembly 100 may include a cylindrical housing 110, which serves to align and protect various internal components of hammer assembly 100. Housing 110 may be formed of one or more discrete pieces, as shown, or it may be a unitary structure. An uphole end 111 of housing 110 is connected to a motor 18, which is operable to rotate a driveshaft 150. Driveshaft 150 is coupled to distal bit 19 via a drill body 140. As described hereinafter with respect to FIG. 5, rotation of driveshaft 150 with respect to housing 110 causes percussive hammer assembly 100 to generate axial impulse forces, which are transferred to bit 19 as bit 19 is rotated.

Downhole tool assembly 12 is carried by conveyance 11, which may be a wireline cable or coiled tubing, for example. A tractor assembly or anchoring device 17 may be provided within downhole tool assembly 12 for counteracting any tendency of downhole tool assembly 12 to rotate as distal bit 19 is rotated. Motor 18 may be an electric motor, powered via wireline cable, a hydraulic motor powered by fluid flow through coiled tubing, or an electric motor powered by a downhole hydraulically-powered electrical generator (not illustrated). Motor 18 may be connected to housing 110 by any suitable arrangement. For example, in the embodiment illustrated in FIG. 3, the flange of motor 18 is connected by bolts or other fasteners 114 to uphole end 111 of housing 110. Drill shaft 150 may be solid or tubular. A tubular drill shaft 150 may allow the capability to provide a source of drilling fluid to distal bit 19, if desired.

Figure 4:
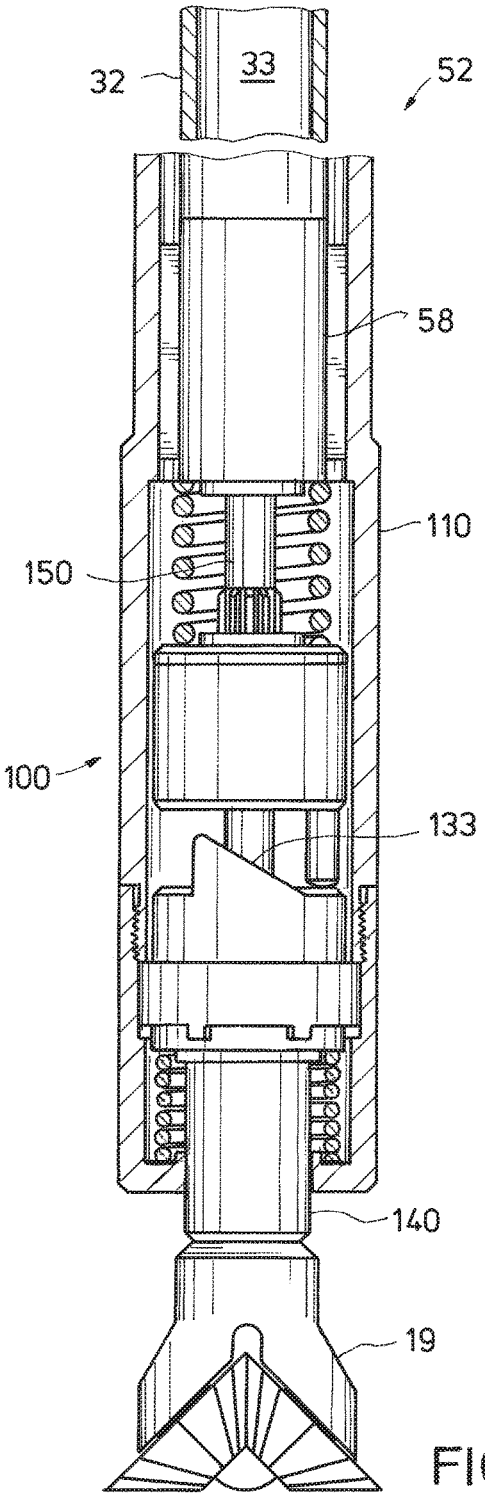
FIG. 4 is an axial cross-section of a lower portion of the bottom hole assembly of FIG. 2 according to an embodiment.

FIG. 4 is an elevation view of a bottom hole assembly 52 of FIG. 2 according to one or more embodiments. Mechanical percussive hammer assembly 100 is shown in partial cross-section. Percussive hammer assembly 100 may include a cylindrical housing 110, which serves to align and protect various internal components of hammer assembly 100. Housing 110 may be formed of one or more discrete pieces, as shown, or it may be a unitary structure. As illustrated in FIG. 4, housing 110 may enclose other components of bottom hole assembly 52, such as mud motor 58. However, separate housings may be provided for the various bottom hole assembly components. Mud motor 58 is operable to rotate a driveshaft 150. Driveshaft 150 is coupled to distal bit 19 via a drill body 140. As described hereinafter with respect to FIG. 5, rotation of driveshaft 150 with respect to housing 110 causes percussive hammer assembly 100 to generate axial impulse forces, which are transferred to bit 19 as bit 19 is rotated.

Bottom hole assembly 12 is carried by drill string 32, which may be assembled from individual lengths of drill pipe, coiled tubing, or other tubular goods, for example. A tractor assembly or anchoring device 17 (FIG. 2) may be provided within downhole tool assembly 12 for counteracting any tendency of bottom hole assembly 52 to rotate as distal bit 19 is rotated. Mud motor 58 may be a Moineau motor or turbine motor, for example, and may provide a flow path of drilling fluid from interior 33 of drill string 32 to driveshaft 150. Driveshaft 150 may be tubular, thereby allowing flow of drilling fluid from mud motor 58 to distal bit 19.

Figure 5:
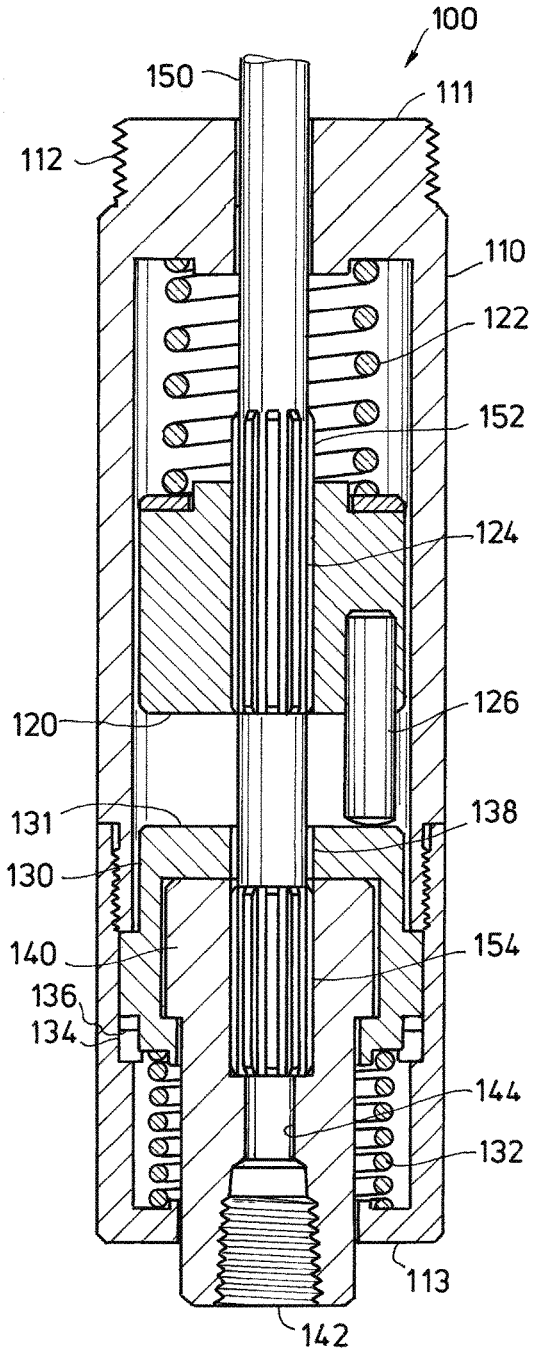
FIG. 5 is a partial axial cross section of a mechanical percussive hammer assembly according to an embodiment, showing a hammer with punch and a drill body rotatively driven by a driveshaft and an anvil having a cammed control surface engaging the hammer.

FIG. 5 is a partial axial cross section of mechanical percussive hammer assembly 100 according to one or more embodiments. Percussive hammer assembly 100 may include cylindrical housing 110, which serves to align and protect various internal components of hammer assembly 100. Housing 110 may be formed of one or more discrete pieces, as shown, or it may be a unitary structure. Uphole end 111 of housing 110 may be arranged for connection to motor 18 provided within tool assembly 12 (FIGS. 1 and 3) or motor 58 provided within bottom hole assembly 52 (FIGS. 2 and 4). Circumferential threads 112 may be provided for such connection purposes, although other suitable arrangements, such as bolting a flange of motor to uphole end 111 of housing 110 (FIG. 3) or enclosing motor within housing 110 (FIG. 4), may be used as appropriate.

According to one or more embodiments, percussive hammer assembly 100 may include a hammer 120, an anvil 130, and a drill body 140. A hammer spring 122 seated between upper end 111 of housing 110 and an upper end of hammer 120 urges hammer 120 in a downward direction against anvil 130. Similarly, an anvil spring 132 seated between a lower end 113 of housing 110 and a lower end of anvil 130 urges anvil 130 in an upward direction against hammer 120. Drill body 140 is rotatively captured within and drill 130 within anvil 130. The lower end of drill body 140 may have a connector 142 for receiving bit 19 (e.g., FIGS. 1-4). Although a threaded box connector is shown, any suitable connector for receiving bit 19 may be used as appropriate.

A circumferential portion of the inner surface of housing 110 has anvil spline grooves 134 formed therein. An outer circumferential portion of anvil 130 has corresponding anvil spline tabs 136 that are slidingly received within anvil spline grooves 134. Anvil spline grooves 134 and tabs 136 allow limited axial movement of anvil 130 within housing 110 but prevent rotation of anvil 130 with respect to housing 110.

A driveshaft 150 extends beyond upper end 111 of housing 110 for connection to a motor, for example electric motor 18 of tool assembly 12 (FIG. 1) or mud motor 58 of bottom hole assembly 52 (FIG. 2). Driveshaft 150 may be rotated with respect to housing 110. Driveshaft 150 passes through a central bore 124 formed through hammer 120 and a central bore 138 formed through anvil 130. The lower end of driveshaft 150 is received within a bore 144 formed in drill body 140. Bore 144 may serve to provide fluid communication from a hollow interior of driveshaft 150 to connector 142 for providing bit 19 (FIGS. 2 and 4) with a supply of drilling fluid.

Driveshaft 150 includes an upper spline 152 which is slidingly received within a complementary spline fitting formed within bore 124 of hammer 120. Accordingly, driveshaft 150 is operable to rotate hammer 120 while allowing hammer 120 to axially slide up and down about upper spline 152. Driveshaft 150 includes a lower spline 154 which is slidingly received within a complementary spline fitting formed within an upper portion of bore 144 of drill body 140. Accordingly, driveshaft is operable to rotate drill body 140 while allowing the drill body 140 and anvil 130 to move in an axial direction with respect to driveshaft 150.

According to one or more embodiments, hammer 120 includes an inertial body. The lower surface of the inertial body of hammer 120 is generally planar with the exception of one or more downward protruding punches 126 that engage the upper surface of anvil 130. The upper control surface 131 of anvil 130 includes one or more elevated cams 133 (e.g., FIGS. 3 and 4). Each elevated cam may have a continuously inclined surface 135 which terminates at its apex 137 by a precipitous drop, or surface substantially parallel to driveshaft 150.

Figure 6A:
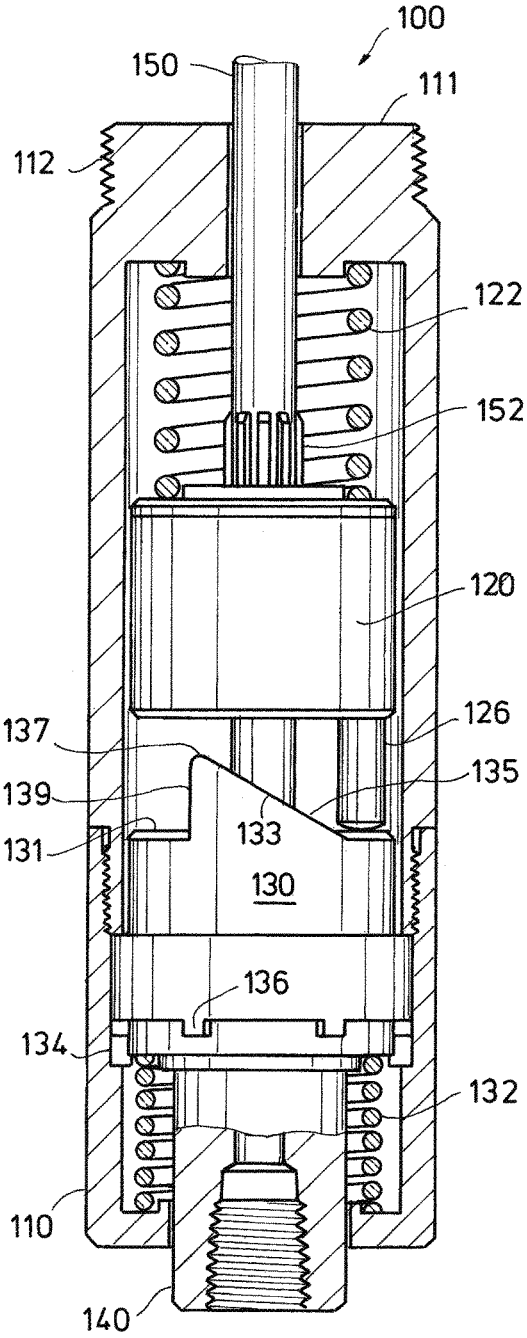
FIG. 6A is a partial axial cross section of the percussive hammer assembly of FIG. 5, showing the hammer punch positioned at a beginning point within a percussive cycle.
Figure 6B:
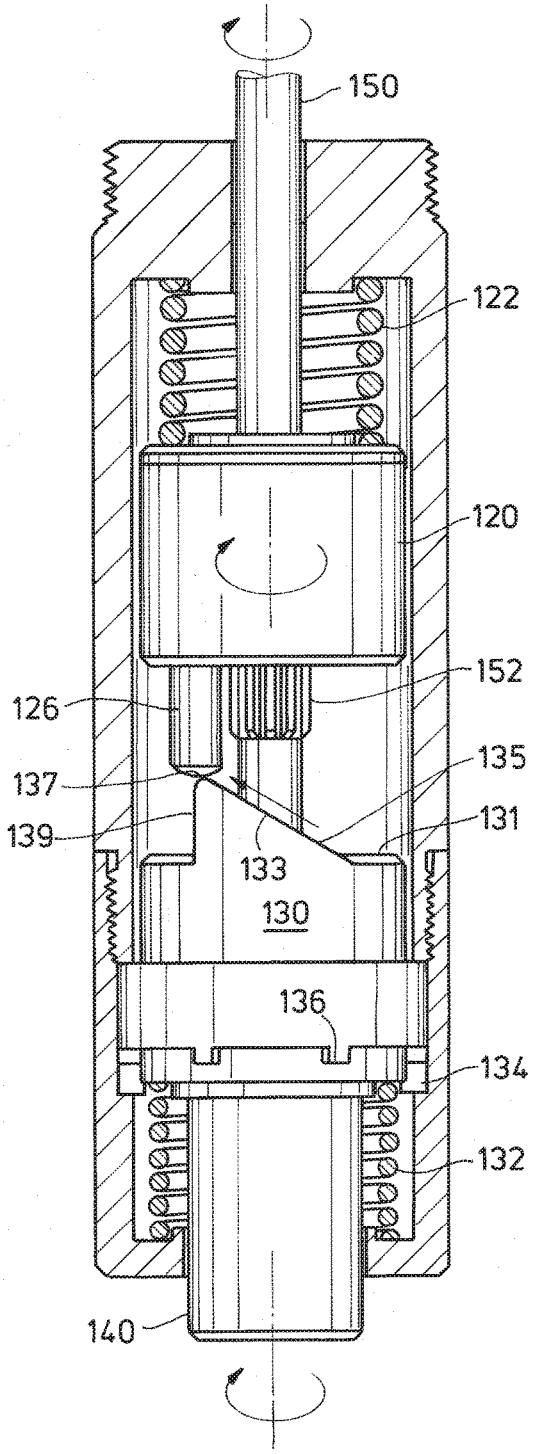
FIG. 6B is a partial axial cross section of the percussive hammer assembly of FIG. 5, showing the hammer punch located at an apex of an anvil cam just prior to producing an impact force.
Figure 6C:
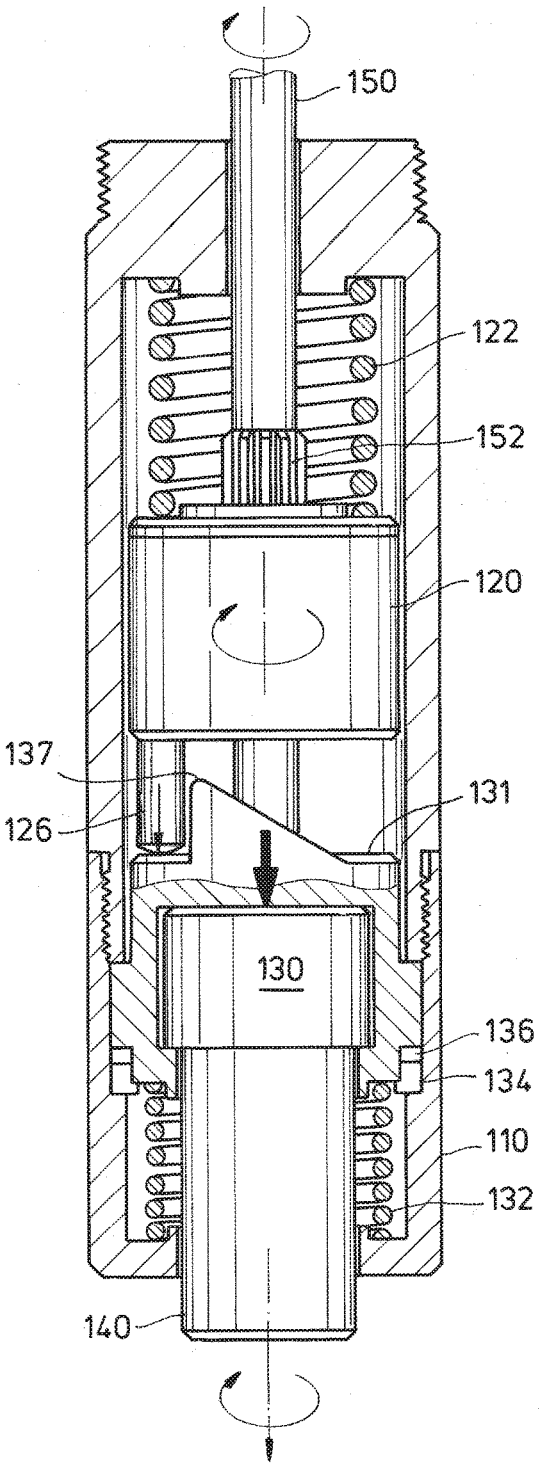
FIG. 6C is a partial cross-section of the percussive hammer assembly of FIG. 5, showing the hammer punch at a point of impact against the anvil.

FIGS. 6A-6C are partial axial cross-sections that illustrate the sequence of operation of percussive hammer assembly 100 according to one or more embodiments. The initial position of the percussive hammer assembly 100 is shown in FIG. 6A. Rotation of driveshaft 150 causes hammer 120 and drill body 140 to rotate. Anvil spline grooves 134 and tabs 136 prevent rotation of anvil 130. Punch 126 of hammer 120 is maintained in contact with anvil 130 under the influence of hammer and anvil biasing springs 122, 132. The upward biasing force of anvil biasing spring 132 may be greater than the downward biasing force of hammer spring 122. As hammer 120 rotates, punch 126 rides upon control surface 131 of anvil 130.

Referring to FIG. 6B, as punch 126 engages and rides along sloped surface 135 of elevated cam 133, hammer 120 is force upward along upper spline 152, thereby compressing hammer spring 122. FIG. 4B illustrates punch 126 located at apex 137 of cam 133, with hammer spring maximally compressed.

Referring now to FIG. 6C, further rotation of driveshaft 150 and hammer 120 causes the punch 126 to fall off apex 137 and rapidly strike anvil 130. The percussive force of hammer 120 striking anvil 130 is transmitted from anvil 132 to drill body 140, and subsequently to bit 19 (FIGS. 1 and 2). Anvil spline grooves 134 and tabs 136 and anvil spring 132 allow axial movement of anvil 130 and drill body 140, thereby transferring the impact of hammer 120 upon anvil 130 directly to bit 19. The percussive cycle is repeated with each revolution of driveshaft 150 with respect to housing 110. The height and circumferential spread of elevated cam 133 upon control surface 131 of anvil 130 determines the force and periodicity of percussive strikes.

Figure 7:
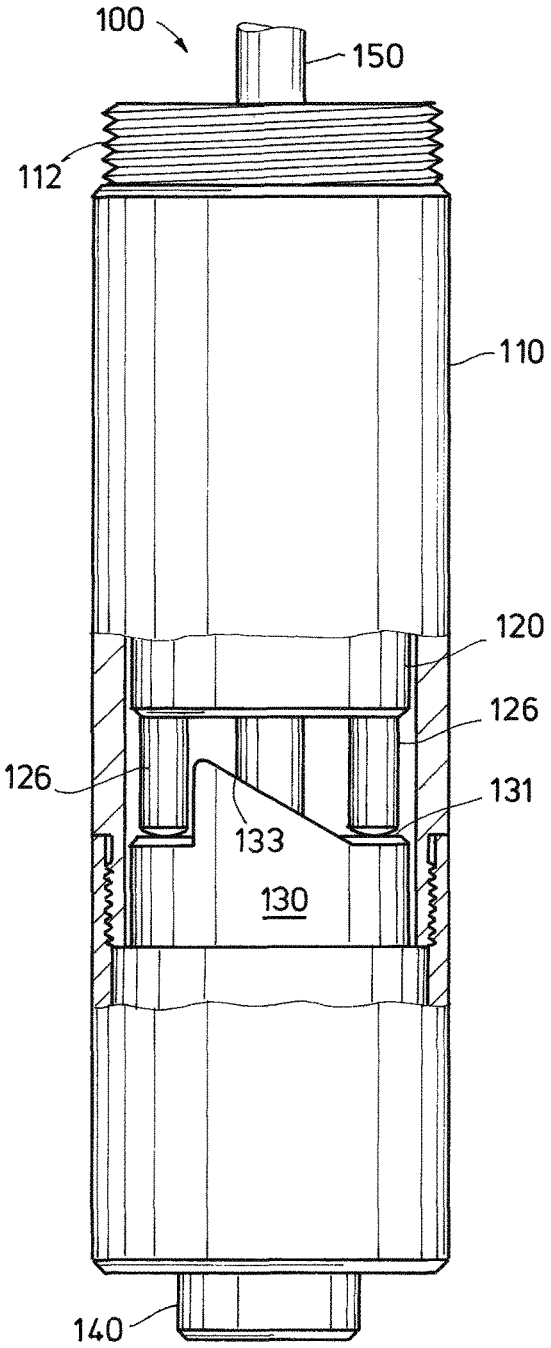
FIG. 7 is an elevation view in partial cross-section of a mechanical percussive hammer assembly according to an embodiment, showing a hammer having two punches and an anvil having a single elevated cam along its control surface.
Figure 8:
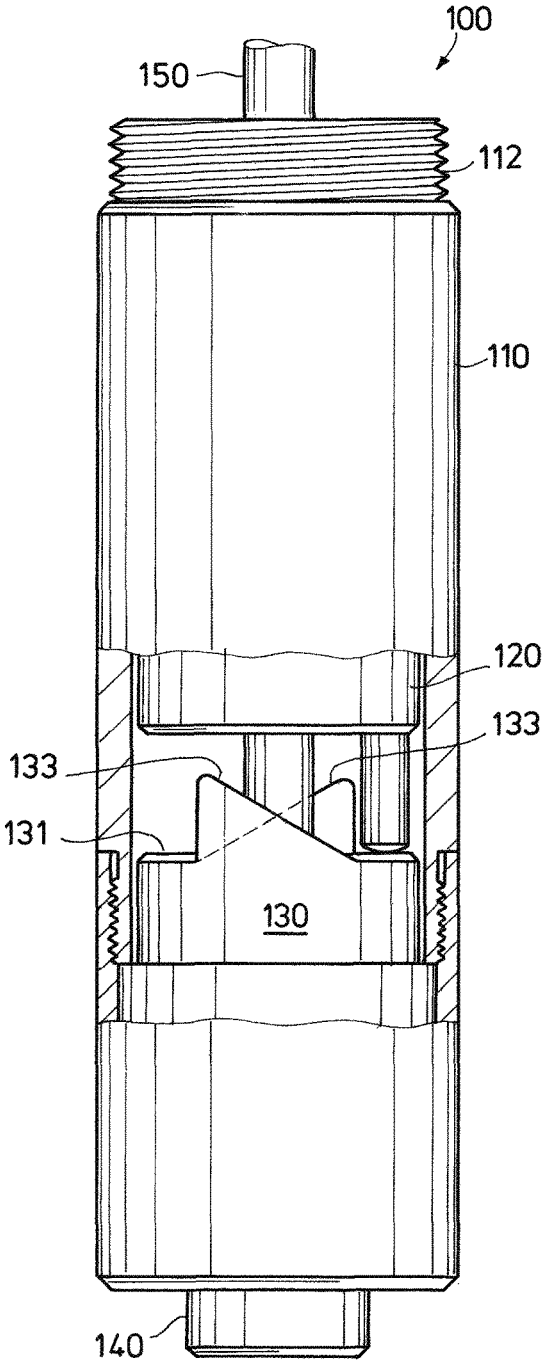
FIG. 8 is an elevation view in partial cross-section of a mechanical percussive hammer assembly according to an embodiment showing a hammer having a single punch and an anvil having to elevated cams along its control surface.

Although FIGS. 6A-6C illustrate a single punch 126 and a single cam 133, multiple punches 126 and/or multiple cams 133 may be provided. For example, FIG. 7 illustrates percussive hammer assembly 100 with hammer 120 having two punches 126 and anvil 130 having a single elevated cam 133 formed upon control surface 131. FIG. 8 illustrates percussive hammer assembly 100 with hammer 120 having a single punch 126 and anvil 130 having dual elevated cams 133 formed upon control surface 131. The embodiments of FIGS. 7 and 8 provide two percussive strikes per rotation of driveshaft 150.

As described hereinabove, percussive hammer assembly 100 may be used for multiple purposes, including as formation drilling, well cleaning, cement plug drilling, etc. Percussive hammer assembly 100 may be run on drill string 32 (FIG. 2) for formation drilling, for example, or on wireline/coiled tubing 11 for wellbore cleaning and plug drilling operations and the like. Rather than using a complicated combination of hydraulic valves and/or pistons to create axial strikes, percussive hammer assembly 100 is a simple mechanical assembly that uses the power of rotation to create axial impact forces on a distal bit for breaking and facilitating penetration tough materials such as rock, hard scale deposits, cement etc. Because percussive hammer assembly 100 is fully mechanical, tool life is increased maintenance requirements are reduced.

Percussive hammer assembly 100 is easily configurable and may be adjusted before each use to match requirements. For example, based on one or more wellbore or formation parameters, it may be determined that a particular impact frequency and force should be used. The number of hammer punches 126 and cams 133 on control surface 131 may be adjusted to provide a varied number of impacts per rotation, as desired. By adjusting the angle and height of cams 133 and the stiffness of biasing springs 122, 132, it is possible to adjust impact force to suit demands. Moreover, percussive hammer assembly 100 may have modular configuration for use with numerous types of rotary motors, including electric, hydraulic, hydraulic-electric, and mud motors, and within multiple types of conveyance systems, including a conventional drill strings, wireline cable, and coiled tubing.

In summary, a percussive hammer assembly and a percussive drilling system have been described. Embodiments of the percussive hammer assembly may generally have: A driveshaft rotatable within a housing; a hammer rotatively coupled to and axially slideable about the driveshaft; a drill body rotatively coupled to and axially slideable about a lower end of the driveshaft; an anvil rotatively fixed within the housing, the anvil rotatively capturing an upper end of the drill body, the anvil defining a control surface in contact with the hammer; and a first cam formed on the control surface; whereby rotation of the driveshaft with respect to the housing is operable to rotate the hammer along the control surface, and the first cam is operable to axially move the hammer with respect to the driveshaft. Embodiments of the percussive drilling system may generally have: A driveshaft rotatable within a housing; a motor operable to rotate the driveshaft with respect to the housing; a hammer rotatively coupled to and axially slideable about the driveshaft; a drill body rotatively coupled to and axially slideable about a lower end of the driveshaft; a bit connected to a lower end of the drill body; an anvil rotatively fixed within the housing, the anvil rotatively capturing an upper end of the drill body, the anvil defining a control surface in contact with the hammer; and a first cam formed on the control surface; whereby rotation of the driveshaft with respect to the housing is operable to rotate the hammer along the control surface, and the first cam is operable to axially move the hammer with respect to the driveshaft.

Any of the foregoing embodiments may include any one of the following elements or characteristics, alone or in combination with each other: A hammer spring disposed within the housing biasing the hammer towards the anvil; the first cam defines first surface having a continuous inclination and a second surface that is substantially parallel with the driveshaft; as the hammer rotates along the first surface, the hammer spring is compressed; when the hammer rotates past the second service, the hammer spring forces the hammer to rapidly strike the anvil; the anvil is axially slideable within the housing; the percussive hammer assembly further comprises an anvil spring disposed within the housing biasing the anvil towards the hammer includes an inertial body; the hammer includes an axial bore formed through the inertial body coupled to the driveshaft with a spline fitting; a first elongate punch protruding from the inertial body engaging the control surface of the anvil; a second elongate punch protruding from the inertial body engaging the control surface of the anvil; the drill body includes an axial bore formed therein coupled to the driveshaft with a spline fitting; the axial bore is formed through the drill body; a lower end of the axial bore forms a connector dimensioned to receive a bit; the driveshaft is tubular and defines a hollow interior in fluid communication with the lower end of the axial bore; a second cam formed on the control surface of the anvil; a conveyance coupled to and suspending the housing; the conveyance is a wireline cable; the motor is an electric motor; the conveyance is a coiled tubing; a drill string coupled to and suspending the housing; the motor is a mud motor; and the housing encloses the motor.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A percussive hammer assembly, comprising:

a driveshaft rotatable within a housing;

a hammer rotatively coupled to and axially slideable about said driveshaft;

a drill body rotatively coupled to and axially slideable about a lower end of said driveshaft;

an anvil rotatively fixed within said housing, said anvil rotatively capturing an upper end of said drill body, said anvil defining a control surface in contact with said hammer; and a first cam formed on said control surface; whereby rotation of said driveshaft with respect to said housing is operable to rotate said hammer along said control surface; and said first cam is operable to axially move said hammer with respect to said driveshaft.

2. The percussive hammer assembly of claim 1 further comprising:

a hammer spring disposed within said housing biasing said hammer towards said anvil.

3. The percussive hammer assembly of claim 2 wherein:
said first cam defines first surface having a continuous inclination and a second surface that is substantially parallel with said driveshaft; whereby
as said hammer rotates along said first surface, said hammer spring is compressed; and
when said hammer rotates past said second surface, said hammer spring forces said hammer to rapidly strike said anvil.

4. The percussive hammer assembly of claim 1 wherein:
said anvil is axially slideable within said housing; and
said percussive hammer assembly further comprises an anvil spring disposed within said housing biasing said anvil towards said hammer.

5. The percussive hammer assembly of claim 1 wherein said hammer comprises:
an inertial body;
an axial bore formed through said inertial body coupled to said driveshaft with a spline fitting; and
a first elongate punch protruding from said inertial body engaging said control surface of said anvil.

6. The percussive hammer assembly of claim 5 further comprising:
a second elongate punch protruding from said inertial body engaging said control surface of said anvil.

7. The percussive hammer assembly of claim 1 wherein said drill body comprises:
an axial bore formed therein coupled to said driveshaft with a spline fitting.

8. The percussive hammer assembly of claim 7 wherein:
said axial bore is formed through said drill body;
a lower end of said axial bore forms a connector dimensioned to receive a bit; and
said driveshaft is tubular and defines a hollow interior in fluid communication with said lower end of said axial bore.

9. The percussive hammer assembly of claim 1 further comprising:
a second cam formed on said control surface of said anvil.

10. A percussive drilling system, comprising:
a driveshaft rotatable within a housing;
a motor operable to rotate said driveshaft with respect to said housing;
a hammer rotatively coupled to and axially slideable about said driveshaft;
a drill body rotatively coupled to and axially slideable about a lower end of said driveshaft;
a bit connected to a lower end of said drill body;
an anvil rotatively fixed within said housing, said anvil rotatively capturing an upper end of said drill body, said anvil defining a control surface in contact with said hammer; and
a first cam formed on said control surface; whereby
rotation of said driveshaft with respect to said housing is operable to rotate said hammer along said control surface; and
said first cam is operable to axially move said hammer with respect to said driveshaft.

11. The percussive drilling system of claim 10 further comprising:
a hammer spring disposed within said housing biasing said hammer towards said anvil.

12. The percussive drilling system of claim 11 wherein:
said first cam defines first surface having a continuous inclination and a second surface that is substantially parallel with said driveshaft; whereby
as said hammer rotates along said first surface, said hammer spring is compressed; and
when said hammer rotates past said second surface, said hammer spring forces said hammer to rapidly strike said anvil.

13. The percussive drilling system of claim 10 wherein:
said anvil is axially slideable within said housing; and
said percussive drilling system further comprises an anvil spring disposed within said housing biasing said anvil towards said hammer.

14. The percussive drilling system of claim 10 wherein said hammer comprises:
an inertial body;
an axial bore formed through said inertial body coupled to said driveshaft with a spline fitting; and
a first elongate punch protruding from said inertial body engaging said control surface of said anvil.

15. The percussive drilling system of claim 14 further comprising:
a second elongate punch protruding from said inertial body engaging said control surface of said anvil.

16. The percussive drilling system of claim 10 wherein said drill body comprises:
an axial bore formed therein coupled to said driveshaft with a spline fitting.

17. The percussive drilling system of claim 16 wherein:
said axial bore is formed through said drill body;
a lower end of said axial bore forms a connector dimensioned to receive a bit; and
said driveshaft is tubular and defines a hollow interior in fluid communication with said lower end of said axial bore.

18. The percussive drilling system of claim 10 further comprising:
a second cam formed on said control surface of said anvil.

19. The percussive drilling system of claim 10 further comprising:
a conveyance coupled to and suspending said housing.

20. The percussive drilling system of claim 19 wherein:
said conveyance is a wireline cable; and
said motor is an electric motor.

21. The percussive drilling system of claim 19 wherein:
said conveyance is a coiled tubing.

22. The percussive drilling system of claim 10 further comprising:
a drill string coupled to and suspending said housing; wherein
said motor is a mud motor.

23. The percussive drilling system of claim 10 wherein:
said housing encloses said motor.

* * * * *